US007832820B2

(12) United States Patent
Sarmast

(10) Patent No.: US 7,832,820 B2
(45) Date of Patent: Nov. 16, 2010

(54) REGULATING ENERGY BASED ON DELIVERED ENERGY

(75) Inventor: Sam M. Sarmast, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 843 days.

(21) Appl. No.: 11/590,048

(22) Filed: Oct. 31, 2006

(65) Prior Publication Data

US 2008/0111527 A1 May 15, 2008

(51) Int. Cl.
*B41J 29/38* (2006.01)
*G05F 1/00* (2006.01)

(52) U.S. Cl. ..... 347/14; 347/5; 323/284; 323/285

(58) Field of Classification Search ..... 347/5, 347/9, 10, 11, 12, 13, 14, 19, 44, 50, 57, 347/58, 59; 323/282, 284, 285, 287, 323, 323/283, 207, 222, 223, 234, 266; 320/163, 320/158; 324/771, 103 R, 416; 327/538, 327/540

See application file for complete search history.

(56) References Cited

U.S. PATENT DOCUMENTS 4,594,501 A * 6/1986 Culley et al. ..... 219/492
4,843,300 A 6/1989 Alderman
5,694,029 A 12/1997 Hayes et al.
5,764,040 A 6/1998 Miller
6,367,023 B2 4/2002 Kling et al.
6,591,073 B1 7/2003 Fujii
6,768,884 B1 7/2004 Buchheit
6,775,156 B1 8/2004 Lin et al.
6,971,731 B2 * 12/2005 Brenner et al. ..... 347/14
7,225,345 B2 * 5/2007 Korcharz et al. ..... 713/300
7,388,360 B2 * 6/2008 Baurle et al. ..... 323/284
7,444,526 B2 * 10/2008 Felter et al. ..... 713/300
7,453,709 B2 * 11/2008 Park et al. ..... 363/21.15
7,466,112 B2 * 12/2008 Zhou et al. ..... 323/259
2005/0197791 A1 9/2005 Matsumoto
2006/0164769 A1 * 7/2006 Stanford et al. ..... 361/87
2007/0083193 A1 * 4/2007 Werneth et al. ..... 606/41
2007/0083195 A1 * 4/2007 Werneth et al. ..... 606/41
2007/0156258 A1 * 7/2007 Briskin ..... 700/40
2008/0253155 A1 * 10/2008 Peng ..... 363/50

* cited by examiner

*Primary Examiner*—Stephen D Meier
*Assistant Examiner*—Rene Garcia, Jr.

(57) ABSTRACT

In one embodiment, a method for regulating energy delivered to a load includes: determining a quantity of energy that has been delivered to the load during a time interval; comparing the quantity of energy delivered with a threshold value; and delaying delivery of additional energy to the load until the time interval has expired if a magnitude of a difference between the threshold value and a sum of the quantity of energy and the additional energy exceeds a predetermined value.

15 Claims, 5 Drawing Sheets

REGULATING ENERGY BASED ON DELIVERED ENERGY

INTRODUCTION

Complying with a safety standard, such as those of the International Electrotechnical Commission (e.g., IEC 60950) and/or Underwriters Laboratories, Inc. (e.g., UL60950), which appear to allow a limited power system to deliver no more than 100 volt-amps (VA) at 60 seconds after a load has been applied, can introduce difficulties in applications that deliver more than 100 VA. For example, limitation of electrical energy delivery with a fuse may not allow a wide range of energy delivery levels within a time window that, nonetheless, does not exceed a threshold of cumulative energy delivery within the time window.

DETAILED DESCRIPTION

The IEC 60950 and UL60950 safety standards appear to allow a limited power system to deliver no more than 100 VA at 60 seconds after a test load has been applied to the output of the limited power system. However, some applications can use power delivery that exceeds 100 VA for brief periods during operation. For these applications it would be desirable for the limited power system to comply with the IEC 60950 and UL60950 safety standards and have the capability to deliver power in excess of 100 VA for relatively small time periods.

For example, one or more printheads of an imaging device may draw more than 100 VA for printing of high density portions of images, whereas printing of low density portions of the same image may be performed drawing levels of electrical power less than 100 VA to maintain a print rate that allows a page to be finished in a specified time interval for the imaging device. In supplying power for performing the printing operation, the energy supplied by the limited power system to the imaging device during the time interval does not exceed an allowable threshold value. An energy regulator can be used to control delivery of power so that the energy delivered during a predetermined time interval does not exceed the allowable threshold value and so that the limited power system will not deliver more than 100 VA at 60 seconds after applying a test load to the limited power system.

Accordingly, in some embodiments of the present disclosure, an apparatus (e.g., a regulator control device) can determine an estimate of a quantity of energy that has been delivered to a load during a time interval. The apparatus can compare the quantity of energy delivered at a time within the time interval to a threshold value corresponding to a quantity of energy that is the greatest amount of energy allowed to be delivered to the load during the time interval. Apparatus embodiments can also be designed to delay delivery of additional energy to the load until the predetermined time span has expired if the quantity of energy delivered during the predetermined time span exceeds the threshold value of energy t.

Figure 1A:
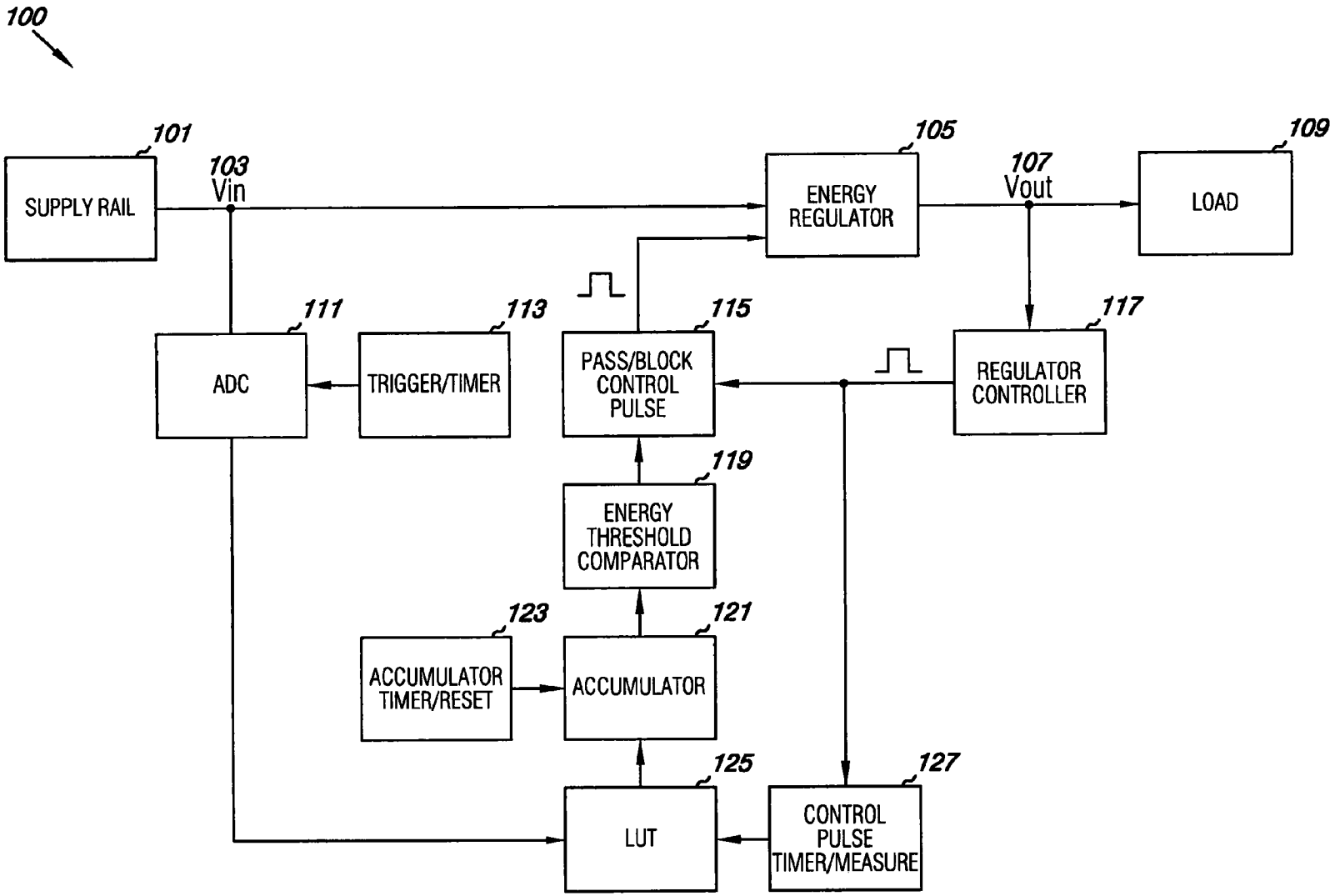
FIG. 1A is a procedural flow block diagram of an embodiment of the present disclosure.

FIG. 1A is a procedural flow block diagram of an embodiment of the present disclosure. It is to be understood that FIG. 1A represents a procedural flow embodiment that includes physical elements, logical elements, and choices associated with such elements.

That is, embodiments of elements illustrated in FIG. 1A can be hardware, logic circuitry, and/or software in various embodiments. In some embodiments, software can include firmware, such as, when implemented in an apparatus embodiment as shown in FIG. 1A.

FIG. 1A illustrates an embodiment of an apparatus 100 linked to a supply rail 101 that can serve as a source for electrical power. In the embodiment illustrated in FIG. 1A, an embodiment of an energy regulator, such as energy regulator 105, can be connected to the supply rail 101. Vin 103 represents the voltage present on the supply rail at the input to energy regulator 105. Vout 107 represents the voltage present at the output of energy regulator 105. The energy regulator 105 can control output of energy to a load 109.

In various embodiments, the energy regulator 105 can supply direct current (DC) and/or alternating current (AC). In some embodiments, electrical current can be converted from AC to DC using one or more converters of various types.

In various embodiments, the energy regulator 105 can utilize various configurations that, in some embodiments, can include buck, boost, forward, and flyback, among others. Such regulators can be controlled by an embodiment of a regulator controller, such as regulator controller 117. Regulator controller 117 measures Vout 107 and generates a signal, comprised of control pulses, having pulse widths that change in response to changes in the measured value of Vout 107. The difference between a measured value of Vout 107 and a desired value of Vout 107 causes the pulse width of the control pulses generated by regulator controller 117 to change in a way such that if the signal was directly supplied to the input of energy regulator 105, the value of Vout 107 would change to reduce a magnitude of the difference between the value of Vout 107 and the desired value of Vout 107. An alternate regulator controller embodiment that could be implemented is referred to as a bang-bang type of controller. In this alternate embodiment, the regulator controller operates by generating pulses having substantially constant pulse widths sufficient to supply the maximum rated output power to the load while maintaining the output voltage within specified limits. Regulation of the output voltage to within the specified limits while less than the maximum rated output power is supplied to the load is accomplished by the regulator stopping generation of the pulses having substantially constant pulse widths until the output voltage drops below a reference voltage value within the specified range of the output voltage. Various embodiments of an energy regulator, as described in the present disclosure, can be utilized to delay delivery of additional energy to the load 109 if the energy delivered during a time interval reaches a threshold level of energy. This can be beneficial, for example, to permit energy regulator 105 to deliver power exceeding 100 VA for portions of the time interval while keeping the power delivered to a test load, at 60 seconds after applying the test load to the output of energy regulator 105, at less than 100 VA.

As shown in the embodiment of FIG. 1A, an analog-to-digital converter (ADC) 111 is coupled to the supply rail 101 to permit measurement of the Vin 103. The ADC 111 can, for example, repeatedly sample a voltage value for Vin 103 at the supply rail 101 at particular times.

This can, for example, be accomplished while energy is supplied from the supply rail 101 to the energy regulator 105. The particular times at which the supply rail 101 voltage is sampled by the ADC 111 can be triggered or metered in various manners. For example, in some embodiments, the time intervals between measurements of Vin 103 can have interval lengths determined by a trigger/timer 113 associated with the ADC 111 and configured to cause ADC 111 to sample in 103 at 2 second intervals.

As shown in the embodiment of FIG. 1A, the ADC 111 can, for example, measure a voltage level of an electrical power source (e.g., the supply rail 101 or at Vin 103). These input voltage values can be utilized as one parameter used to access values in a look-up table (LUT). In the embodiment illustrated in FIG. 1A, a supply rail voltage, for instance, can be used as a first variable parameter to access values in a two-dimensional LUT 125.

In various embodiments of the present disclosure, such as the embodiment shown in FIG. 1A, the supply rail 101 can be connected to an energy regulator 105 that can control electrical power delivered to a load 109. In various embodiments, the energy regulator 105 can be associated with a regulator controller 117. In some embodiments, the regulator controller 117 can be associated with a control pulse timer/measure component 127.

The control pulses, of variable pulse widths, generated by the regulator controller 117, in some embodiments, are coupled to the control pulse timer/measure component 127. Control pulse timer/measure component 127 includes the capability to determine widths of the control pulses generated by regulator controller 117. As previously mentioned, the widths of these control pulses are related to the power to be delivered to the load 109 as controlled by the energy regulator 105. In some embodiments, an energy regulator 105 can be directly associated with a control pulse timer/measure component 127 for generating pulses and measuring the pulse widths without use of a regulator controller 117.

The control pulse timer/measure component 127 can, in the embodiment shown in FIG. 1A, measure a time span of each control pulse and supply such pulse width values to be utilized as one parameter to access values stored in a LUT. In the embodiment illustrated in FIG. 1A, the measured control pulse time spans can be used as a second variable parameter to access the values stored in the two-dimensional LUT 125.

It should be recognized that although embodiments of the apparatus 100 make use of measured values for two parameters for accessing values in the LUT 125, other embodiments of the apparatus and of look-up tables could make use of a greater number of measured values or a lesser number of parameters. For example, a look-up table could be used to store values that are estimates of delivered energies that additionally use measured values of load current, along with pulse width and voltage, for generating the look-up table values and accessing the look-up table values. Because efficiency of the energy regulator can change based upon the load current, changes in the load current affect the quantity of energy delivered, as well as the regulator controller pulse width and the energy regulator input voltage. Or, a look-up table could be used to store values that are estimates of delivered energies that additionally uses measured values of load current and temperature, as well as the regulator controller pulse width and the energy regulator input voltage for generating the look-up table values and accessing the look-up table values. Changes in temperature affect the operation of components in the energy regulator, thereby changing the quantity of energy delivered. Further input dimensions of a look-up table could be used. In general, it is expected the greater the number of parameters used in generating and accessing the look-up table values the greater the accuracy achieved in the estimate of delivered energy provided by the look-up table.

As illustrated in the embodiment of FIG. 1A, an accumulator 121 can receive the values provided by the LUT 125, accessed using the information received from the ADC 111 and control pulse timer/measure component 127. For example, the accumulator 121 can receive information from the LUT 125 relating to quantities of energy that would be delivered by the energy regulator 105 to load 109 corresponding to the widths of the control pulses generated by regulator controller 117, as measured by control pulse timer/measure component 127, and used, along with a measured value of Vin 103 to access values corresponding to the quantities of energy stored in the LUT.

In some embodiments of the present disclosure, a voltage signal provided to an ADC 111 for measurement as a parameter used to access values in a LUT can be obtained by measurement of an output voltage present between energy regulator 105 and load 109. Another measurement that, in some embodiments, can be used to access values in the LUT is a measurement of output current provided by energy regulator 105 to load 109 and obtained, for example, from a current sensor measuring the output current. With respect to current sensor embodiments, the current sensor can be associated with a timer, which can, in various embodiments, determine and/or regulate timing of current measurements, and/or measurements of an ADC for providing values usable with the LUT.

As shown in the embodiment of FIG. 1A, determining the quantities of energy corresponding to the widths of control pulses generated by regulator controller 117 can be accomplished by measuring the widths of control pulses comprising the signal provided by the regulator controller 117 and a value of voltage related to the voltage supplied to load 109, such as Vin 103 or Vout 107, or a value of current related to current supplied to load 109. In some embodiments, measurements of control pulse widths can be determined by the control pulse timer/measure component 127.

A value for the quantity of energy delivered that corresponds to each control pulse can be determined by a LUT 125 using the values of above described parameters (e.g., voltage values or current values, and values of control pulse widths) as index values to access values corresponding to energies stored in LUT 125. The LUT 125 performs internal comparisons using the index values to select predetermined values of energy corresponding to the index values. The energy quantities derived from these periodic comparisons can be added by an accumulator 121. Accumulator 121 determines a sum of the values of energy provided to it by the LUT 125 during a time interval. The accumulated value can then be used to determine a cumulative quantity of energy already delivered during a time interval and that would be delivered if the most recently generated control pulse by regulator controller 117 is provided to the energy regulator 105 as a pass/block control pulse.

In various embodiments of the apparatus 100, such as the embodiment illustrated in FIG. 1A, an accumulator timer/reset 123 component can be associated with the accumulator 121. The accumulator timer/reset 123 component can, in some embodiments, provide a programmed (e.g., predetermined) time interval during which individual values of energy quantities provided by the LUT 125 are to be summed to determine a cumulative total already delivered to the load 109 and that would be delivered if the most recently generated control pulse by regulator controller 117 is provided to the energy regulator 105 as a pass/block control pulse.

The accumulator timer/reset 123 component can, in some embodiments, reset the value stored in the accumulator and thereby set the time interval during which individual energy pulse quantities are to be summed. Such an arrangement can allow the apparatus to determine a cumulative energy already delivered to the load 109 and that would be delivered if the most recently generated control pulse by regulator controller 117 is provided to the energy regulator 105 as a pass/block control pulse during the time interval.

A value for the cumulative quantity of energy delivered, during a time interval over which values of energies supplied by LUT 125 are summed, can be supplied to an energy threshold comparator 119 at various intervals, which, by way of example, can be at the end of providing each control pulse to energy regulator 105. The value for the cumulative quantity of energy is provided to the energy threshold comparator 119, as shown in the embodiment illustrated in FIG. 1A. The energy threshold comparator 119 can be programmed, in various embodiments, with a threshold quantity of energy that is allowed to be delivered to the load 109 during a time interval. In such embodiments, the energy threshold comparator 119 can determine whether the cumulative quantity of energy delivered so far during the time interval exceeds the threshold energy quantity within the time interval.

The determination by the energy threshold comparator 119 as to whether the cumulative quantity of energy delivered during the time interval exceeds the threshold energy quantity within the time interval can be supplied as a signal to pass/block control pulse component 115, as shown in the embodiment of FIG. 1A. The signal provided by pass/block control pulse component 115 can be provided at various time intervals (e.g., at the end of delivering each control pulse from regulator controller 117 to energy regulator 105).

In such embodiments, based upon the signal provided by the energy threshold comparator 119 to pass/block control pulse 115, the pass/block control pulse component 115 passes a signal having a pulse width corresponding to the width of the control pulse generated by regulator controller 117 to the input of energy regulator 105 or does not permit a pulse corresponding the control pulse generated by regulator controller 117 to reach the input of energy regulator 105, thereby reducing the energy that would otherwise be supplied by energy regulator 105 to load 109 during the time interval.

For example, if the energy threshold comparator 119 determines that the cumulative quantity of energy delivered does not exceed the threshold quantity of energy, the pass/block control pulse component 115 passes a pulse corresponding to the control pulse from regulator controller 117 to energy regulator 105. Conversely, if the energy threshold comparator 119 determines that the cumulative quantity of energy delivered exceeds the threshold quantity of energy, in some embodiments, the pass/block control pulse component 115 can be used to block one or more control pulses from regulator controller 117.

In some embodiments, the energy threshold comparator 119 can determine that providing another pass/block control pulse to energy regulator 105 would cause the energy quantity delivered to the load 109 during the time interval to exceed the threshold quantity of energy. In such instances, the energy threshold comparator 119 can cause the pass/block control pulse component to block the control pulse from regulator 117 blocked so that the threshold quantity of energy is not exceeded.

As shown in the embodiment illustrated in FIG. 1A, by way of example and not by way of limitation, the energy threshold comparator 119, pass/block control pulse 115, and regulator controller 117 can operate to control delivery of power to the load 109 through control of the operation of energy regulator 105. In some embodiments, the delivery of energy to the load 109 can be controlled at different locations in the energy delivery pathway.

In some embodiments, the regulator controller 117 and the energy regulator 105 can be located in, and perform functions as, a single component. For example, an output regulator associated with a regulator control device can, in some embodiments as described below, exert direct control over delivery of power to a load.

In some embodiments of the present disclosure, controlling delivery of a quantity of energy can be utilized in controlling delivery of energy to a load, (e.g., controlling delivery of energy to a printhead in an imaging device), among other applications. It should be recognized that in systems using other kinds of loads the disclosed techniques could be beneficially applied. For example, systems having loads including motors, heaters, power amplifiers, and electromechanical actuators, more effective control of power delivered to the loads could be achieved using the disclosed techniques. In various embodiments, the energy threshold value used by the energy threshold comparator 119 can be premised upon limiting a quantity of energy deliverable during a time interval based on consideration of longevity of the printhead and/or components of the imaging device, an image quality on a print medium, and/or a safety factor of personnel in a vicinity of the imaging device, among other factors.

In some embodiments, determining the energy threshold value can be premised upon complying with an applicable standard, which can include complying with a safety standard that limits power supplied by a power source to a load as determined by measurement of the apparent power provided by the power source (as determined by the product of the voltage and current provided by the power source) wherein limiting the apparent power is accomplished by delivering a limited energy to the load within a time interval. Examples of such safety standards can include complying with IEC 60950 and/or UL60950, which allow for a limited power system to deliver no more than 100 VA at 60 seconds after application of the test load.

For instance, in some embodiments, if a 6.0 second time interval is being used for measurement of energy delivered (it should be noted that a variety time interval lengths could be selected dependent, at least in part, on the number of storage bits desired in the various registers and the power consumption profile of the loads supplied by the limited power system), and less than 600 joules of energy, such as 590 joules of energy, delivered in that 6.0 second time interval has been selected as energy threshold quantity (it should be noted that different energy threshold quantities could be used depending, at least in part, on the power consumption demands over the time interval of the load to be supplied and the details of the testing used to determine compliance with the various safety standards), the peak power delivered in that time interval can exceed 100 watts for time periods during each of the 6 second time intervals that occur to meet transient power demands of the load (such as an image forming system) and yet provide no more than 100 VA of apparent power at 60 seconds after application of the test load during a safety standard compliance test.

Although embodiments of apparatus 100 have been disclosed in the context of providing no more than 100 VA of apparent power at 60 seconds after application of the test load while having the capability to provide more than 100 VA for other time periods, other beneficial applications of embodiments of apparatus 100 are possible. For example, embodiments of apparatus 100 could be used for detection and protection in the event of fault conditions in the load resulting in delivery of amounts of power in excess of levels experienced during normal operation or in the event of fault conditions in the load resulting in delivery of amounts of power below levels experienced during normal operation. In response to the detection of either of these fault conditions, the delivery of additional pass/block control pulses could be halted until the start of the next time interval, for the possibility in which recovery from the fault is possible. Or, the delivery of additional pass/block control pulses could be halted until power cycling of the system including the apparatus is done in the event the fault condition could correspond to a safety concern.

Based upon characteristics of the specific type of load coupled to the output of the energy regulator that are determined, the level of power above or below that expected during normal operation that corresponds to a fault condition could be set. For example, if the load included a motor, for an open in the motor, this could be detected by cumulative energy at some time during or at the end of the time interval being less than the lower fault condition value and then the pass/block control pulses to the energy regulator could be interrupted until at least power cycling of the system. Or, for a short in the motor, this would likely cause the cumulative energy delivered to increase to the upper fault condition value relatively early on during a time interval and then the pass/block control pulses to the energy regulator could be interrupted until at least power cycling of the system.

Other embodiments of apparatus 100 could be implemented for which pass/block control pulse component 115 includes the capability to modify the width of the pass/block control pulses depending upon the difference that remains between the value of the cumulative energy measured to a time during a time interval and the allowable quantity of energy for the time interval. For example, the width of the pass/block control pulses could be decreased as the magnitude of this difference decreases, thereby ramping down the power supplied to the load to the end of the time interval. This would provide the benefit that the level of power supplied to the load would not change as abruptly as it would with blocking application of pass/block control pulses when the limit is reached. For these embodiments of apparatus 100, energy threshold comparator would include the capability to generate a signal indicative of the magnitude of the difference between the energy threshold quantity for the time interval and the cumulative energy currently delivered during the time interval.

Figure 1B:
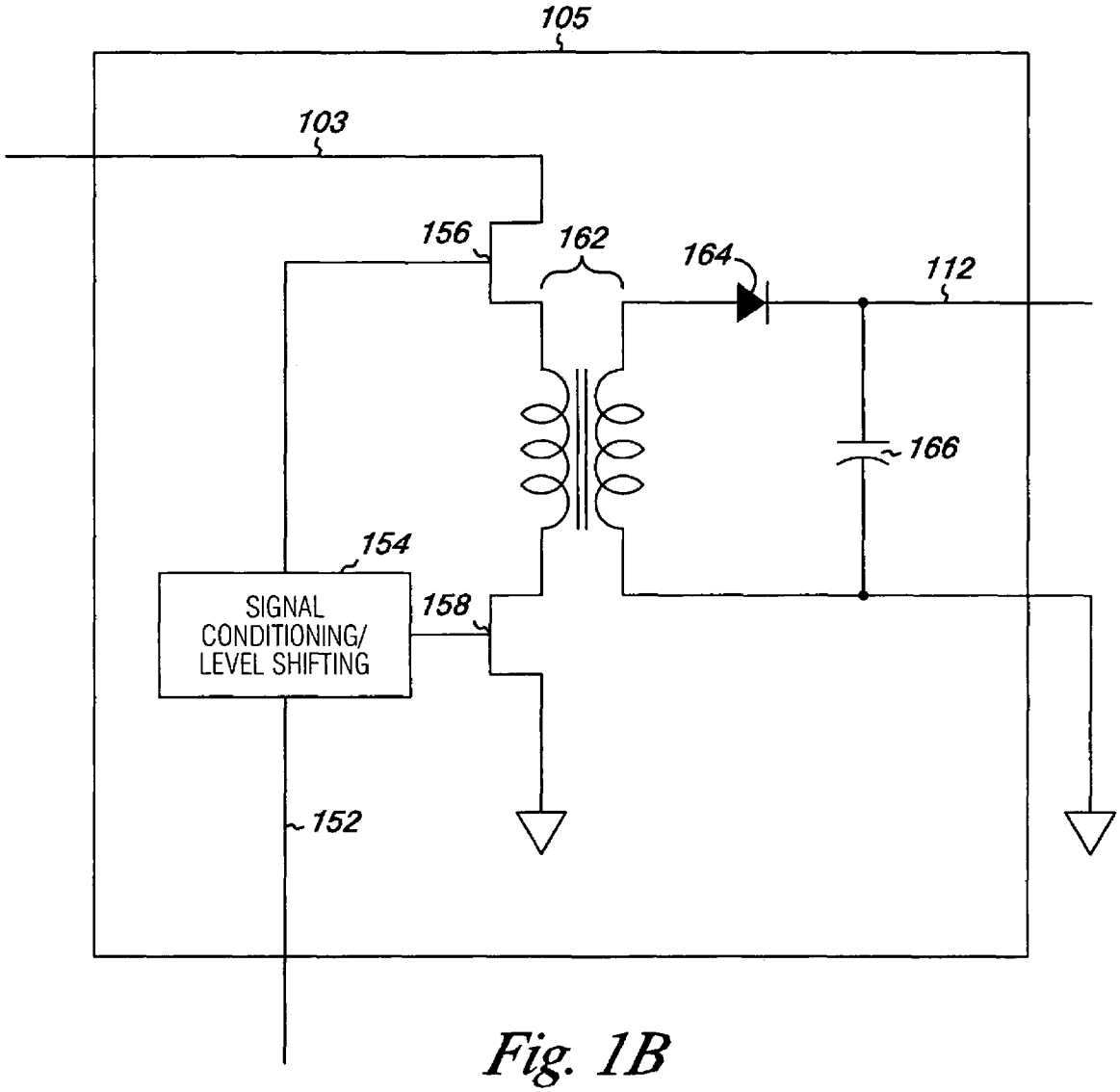
FIG. 1B is an embodiment of a layout of components of an energy regulator.

Shown in FIG. 1B is a simplified schematic representation of a possible embodiment of energy regulator 105, illustrated in FIG. 1A. The embodiment of FIG. 1B includes Vin 103, Vout 112, an input 152, a signal conditioning/level shifting component 154, a first switch 156, a second switch 158, a transformer 162, a diode 164, and a capacitor 166. Although this circuit provides one embodiment of a suitable circuit to be used in an energy regulator, an energy regulator can be implemented in various manners.

In the embodiment illustrated in FIG. 1B, to couple energy to capacitor 166 (and/or load 109) through transformer 162, first switch 156 and second switch 158 are closed and then opened with application of a control pulse to input 152. However, if pass/block control pulse component 115 does not allow a pass/block control pulse to be applied to the input of energy regulator 105, then substantially no energy will be coupled to capacitor 166 (and/or load 109) through transformer 162.

Figure 2:
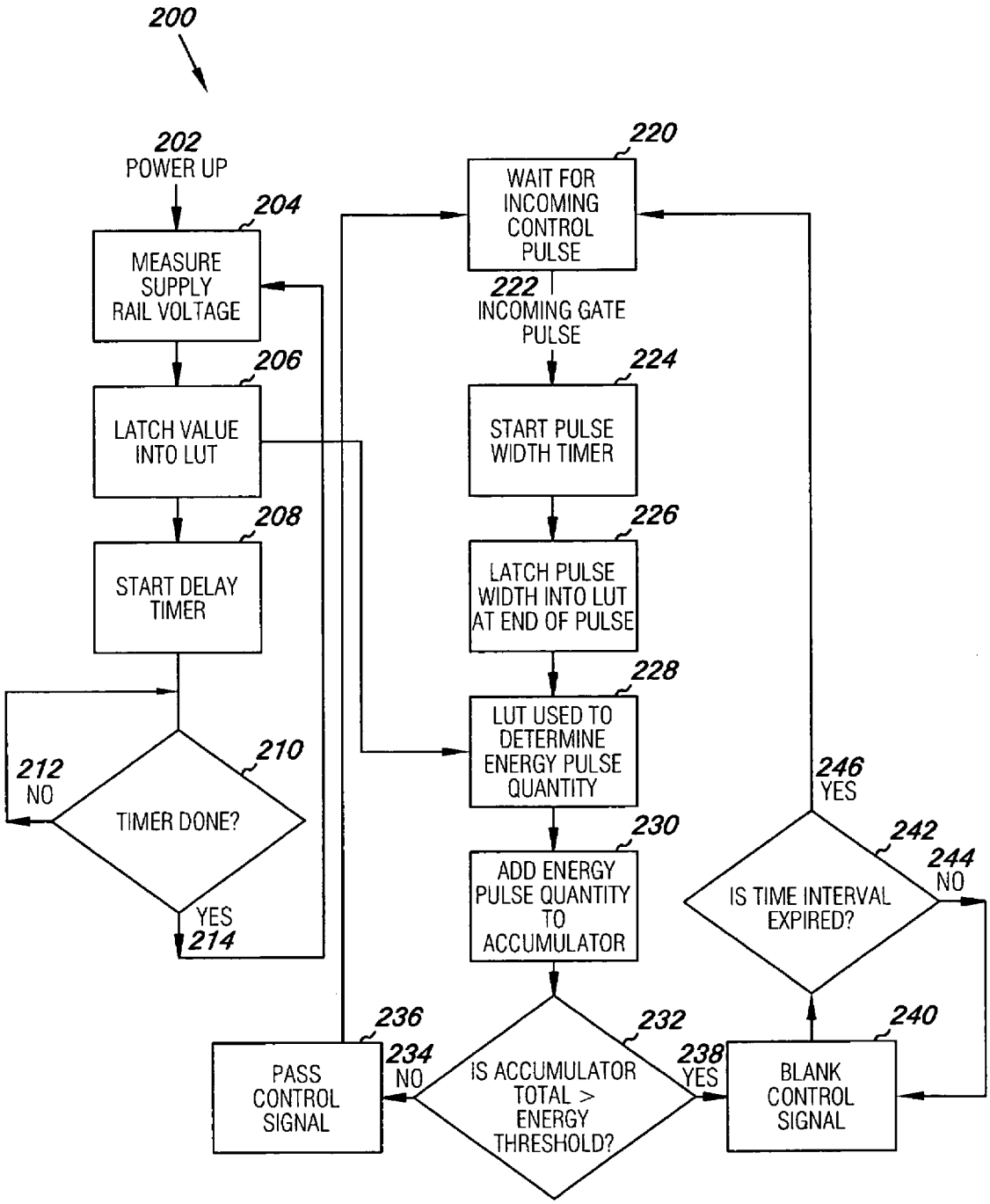
FIG. 2 illustrates operation of an apparatus according to an embodiment of the present disclosure.

FIG. 2 illustrates operation 200 of an apparatus according to an embodiment of the present disclosure. As shown in FIG. 2, the embodiment of the apparatus can begin operation when power is provided to "power up" 202 the apparatus. In such an embodiment, when power is being delivered from a power source, a supply rail voltage can be measured 204 as a particular value at that particular time point, for example, by the ADC 111 shown in FIG. 1A.

As shown in FIG. 2, the particular voltage value measured at the particular time can be latched into a register and provided 206 as a parameter into a LUT. In some embodiments, a voltage level of the supply rail can be measured at a plurality of times within particular time intervals during operation of the apparatus.

For example, as illustrated in the embodiment of FIG. 2, when a supply rail voltage has been latched into a register, a delay timer can be started 208. In such embodiments, following the start 208 of the delay timer, a determination 210 can be made as to whether the timer is done completing a timing cycle.

If the determination is No at 212, that is, the timer is not done with a timing cycle, the timer can, in some embodiments, continue timing the cycle without repeating a measurement 204 of the supply rail voltage. If the determination is Yes at 214 and the timer is done with a timing cycle, the timer can cause measurement 204 of the supply rail voltage to be repeated. In such embodiments, a timed repetition of supply rail voltage measurements can continue until the supply of power to apparatus has been terminated and/or delivery of power to power supply (e.g., energy regulator 105 shown in FIG. 1A) has been interrupted, among other situations.

As illustrated in the embodiment shown in FIG. 2, the operation 200 of an apparatus, such as apparatus 100, is described. The apparatus can be designed to utilize a pass block control pulse (e.g., the signal provided by pass/block control pulse component 115 shown in FIG. 1A) to cause energy to be delivered to a load. For example, as shown in FIG. 1A, delivery of the pass/block control pulse to energy regulator 105 can be initiated using a determination by the energy threshold comparator 119 that the energy threshold quantity has not been exceeded and a pass/block control pulse can be provided to an energy regulator 105, or using components of a regulator control device, as described below.

In the embodiment of the operation shown in FIG. 2, at 220, the apparatus is waiting for delivery of a control pulse. At 222, the control pulse has been detected.

At 224, a timer is started to measure the width of the control pulse. At 226, at the end of the control pulse the value of the control pulse width is used to access a LUT that can be, in some embodiments, the same LUT accessed using 206 the measured value of the supply rail voltage.

In some embodiments, the supply rail voltage can be measured 204 at the time of initiation and/or end, or in between, of the incoming control pulse. At 228, the embodiment of FIG. 2 utilizes a LUT that stores energy values that can be accessed, using parameters such as control pulse width and input voltage as input parameters, to provide, in response, energy values that correspond to quantities of energy that are delivered by energy regulator 105 for the measured values of pulse width and voltage.

As further shown in FIG. 2, at 230, the energy values provided by the LUT at 228 are added to the cumulative value of energy delivered value stored in the accumulator to provide a value of the cumulative energy that would be delivered during the time interval if the most recently received control pulse were provided to energy regulator 105 as a pass/block control pulse. At 232, using the cumulative energy quantity determined by the accumulator, a determination can be made as to whether the cumulative energy value in the accumulator exceeds a threshold energy quantity for that time interval.

In various embodiments, a comparator can be used to determine whether a cumulative quantity of energy delivered exceeds a threshold energy quantity within the time interval. Determining with the comparator whether the cumulative quantity of energy delivered exceeds the threshold energy quantity within the time interval can be accomplished in various manners.

As shown in FIG. 2, in some embodiments, at 236, if a determination is made that the cumulative energy quantity does not, at 234, exceed the threshold energy quantity within the time interval, a pass control signal can be asserted to allow a pass/block control pulse to be applied to energy regulator (e.g., energy regulator 105 of FIG. 1A). Conversely, at 240, if the determination is that the cumulative energy quantity does exceed, at 238, the threshold energy quantity within the time interval, a blank control signal 240 can be asserted that blocks (e.g., interrupts and/or delays) delivery of a pulse corresponding to the most recently received control pulse.

In such embodiments, it is determined at 242 whether the time interval has expired. That is, when the time interval has not expired, at 244, a blank control signal 240 can continue to be asserted to interrupt and/or delay delivery of future pass/block control pulses after the most recently generated control pulse within that time interval to stop or at least reduce a likelihood of further exceeding the energy quantity threshold. Conversely, when the time interval has expired, at 246, a blank control signal 240 can be de-asserted and the apparatus can return operation to 220 to wait for the next control pulse because such additional energy resulting from the application of the next pass/block control pulse to energy regulator 105 will not contribute to exceeding the energy quantity threshold in the preceding time interval.

Various embodiments of the operation 200 illustrated for an apparatus corresponding to FIG. 2 can, for example, be performed in supplying power to components of an imaging device, including printheads. By way of example and not by way of limitation, the starting of the pulse width timer at 224 shown in FIG. 2 can be started at the beginning of a control pulse for delivering power to one or more printheads in an imaging device for printing text and/or an image on a print medium.

In some embodiments, a pulse width timer can be started in a synchronous manner with one or more printheads beginning printing on a page of a print medium and/or in an asynchronous manner with the printing of a page of the print medium. In some embodiments, the time interval can be set so as to exceed a length of time used by one or more printheads for printing of a page of the print medium. For example, in an imaging device in which printing of a page is typically performed in a second or less, a time interval can be set to a length such that printing of the page can be performed during measurement of energy delivered during a time interval, while some drying time is provided for ink deposited on the print medium, before another time interval is begun for measurement of energy delivered.

Figure 3:
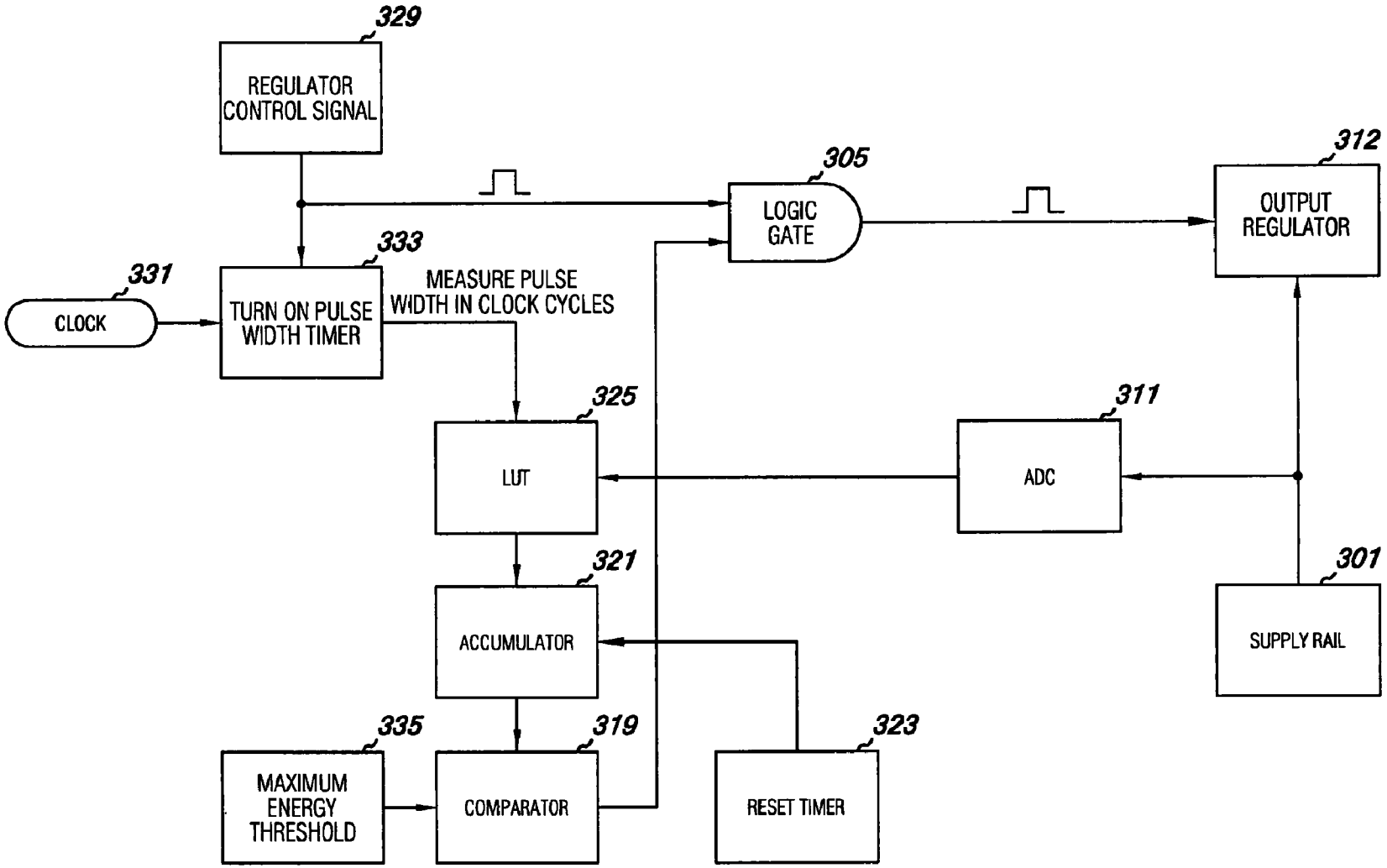
FIG. 3 is a block diagram of an apparatus including an energy regulator control device according to an embodiment of the present disclosure.

FIG. 3 is a block diagram of an apparatus including an energy regulator control device according to an embodiment of the present disclosure. As illustrated in FIG. 3, an embodiment of an apparatus can have a regulator control signal 329 that is received by a regulator control device.

In various embodiments, the regulator control signal 329 can, for example, be a signal intended to cause delivery of electrical energy to a load. As illustrated in FIG. 3, in some embodiments, one or more regulator control devices can be used in an imaging device to regulate delivery of electrical energy to one or more loads serving as components thereof, including one or more printheads of the imaging device.

In those embodiments that utilize a plurality of regulators to regulate delivery of electrical energy to a plurality of printheads to print a page of print medium, the cumulative energy delivered to the printheads to print the page can be divided for delivery among the plurality of regulators, thereby distributing the energy delivered during a particular time interval between the plurality of regulators and reducing the quantity of energy delivered by each regulator in the particular time interval. For example, in a situation where printing of a page of a print medium uses up to 120 VA of power, if the page is printed by four printheads each controlled by a separate regulator, the greatest power delivered by each regulator can be less than 120 VA (e.g., 120 VA÷4=30 VA for loads of equal peak power). Applying the disclosed time interval energy limitation techniques, each of the regulators can be controlled to deliver adequate levels of power for proper operation of the printheads during the time interval while not exceeding 100 VA of apparent power at 60 seconds after application of a test load, thereby complying with applicable standards (e.g., IEC 60950 and/or UL60950).

As illustrated in the embodiment of FIG. 3, the apparatus illustrated therein can function as a power supply circuit. The embodiment shown in FIG. 3 includes a clock 331 (e.g., a 20 MHz electronic clock) working in concert with a pulse width timer 333. The pulse width timer can measure pulse width in various manners and use various units to measure the pulse width (e.g., width can be measured in clock terms of cycles).

In such embodiments, the pulse width timer 333 can work in concert with the output control signal 329 to regulate delivery of output power to a device component. In some embodiments, the device component can include one or more components of an imaging device, such as one or more printheads.

Power supplied to such a system can, in various embodiments, be allocated to a plurality of regulator control devices, which, in some embodiments, can control delivery of power to load for one or more printheads of an imaging device, among other components of the system.

An output regulator 312 can be used to receive input of an output control signal from a logic gate that gates the application regulator control signal to the output regulator 312. The output control signal can control receipt of power by the by the output regulator 312.

As such, the output regulator 312 can regulate output of energy to a load, as discussed above. As described above, a voltage supply ADC 311 can be designed to convert a voltage, which, in some embodiments, can be at the supply rail 301 or at the output regulator 312. The apparatus can also be designed to take measurements at various predetermined time intervals, and/or provide a value corresponding to the voltage measurement at one or more particular times, to be used to access values in a LUT 325.

In various embodiments, the regulator control signal 329 can be utilized to turn on the pulse width timer 333 to measure the width of pulses in the regulator control signal. When an initial and/or one or more subsequent pulses are delivered by the regulator control signal, the pulse width timer 333 can measure the pulse width, for example, by determining a number of clock cycles that have passed from the leading edge to the falling edge of the pulse. In such embodiments, the pulse width (e.g., the number of clock cycles) can be used in association with the voltage measurement from the ADC 311, as described above, as inputs into the LUT 325 to access a corresponding value of an energy.

As shown in the embodiment of FIG. 3, the apparatus can include, in various embodiments, an accumulator 321, as described above. An accumulator 321 can be utilized, for example, to add values of energy provided by the LUT 325 to obtain an estimate of the cumulative quantity of energy delivered by the output regulator. As further shown in FIG. 3, a comparator 319 can be utilized to determine whether the estimate of the cumulative quantity of energy delivered by the output regulator 312, as determined, for example, by the accumulator 321 adding values of energy delivered for each of the pulses in the regulator control signal 329, exceeds an energy threshold value during a time interval.

A threshold of allowable energy to be delivered during a time interval can be provided to the comparator 319 as a programmable energy threshold 335, for example. A reset timer 323 can be connected, in various embodiments, to accumulator 321 of a regulator control device. A reset timer 323 can be used to control, for example, when one time interval ends and another time interval begins and/or the duration of each time interval. The reset timer 323 can be used to reset the value in the accumulator 321 to zero.

As further shown in the embodiment of FIG. 3, a comparator 319 can be connected, in various embodiments, to a logic gate 305. In such embodiments, the comparator 319 can be coupled to the logic gate 305 such that the comparator 319 can provide pass/block control pulse to the logic gate 305 as discussed above.

A pass/block control pulse can be used, in some embodiments, to with the logic gate 305 to delay delivery of energy until the time interval has expired when the cumulative quantity of energy exceeds the predetermined energy threshold during the time interval. That is, in various embodiments, the logic gate 305 of the regulator control device can delay electrical output delivery to a load from the power supply rail 301 until the time interval has expired if the quantity of energy delivered to the load during the time interval exceeds the programmable energy threshold 335. In some embodiments, more than one threshold may be used and in such embodiments, rather than delaying the regulator control signal pulse, it can be metered to reduce the tendency for the energy to exceed the cumulative energy threshold, As illustrated in the embodiment of FIG. 3, components of the regulator control device that provide the electrical supply circuit can, in various embodiments, include integrated elements that, by way of example and not by way of limitation, include the comparator 321 and the logic gate 305. In some embodiments, elements of the logic gate 305 can be integrated and can be formed from a group that includes, by way of example and not by way of limitation, a complex programmable logic device (CPLD), a field programmable gate array (FPGA), and/or an application specific integrated circuit (ASIC).

Figure 4:
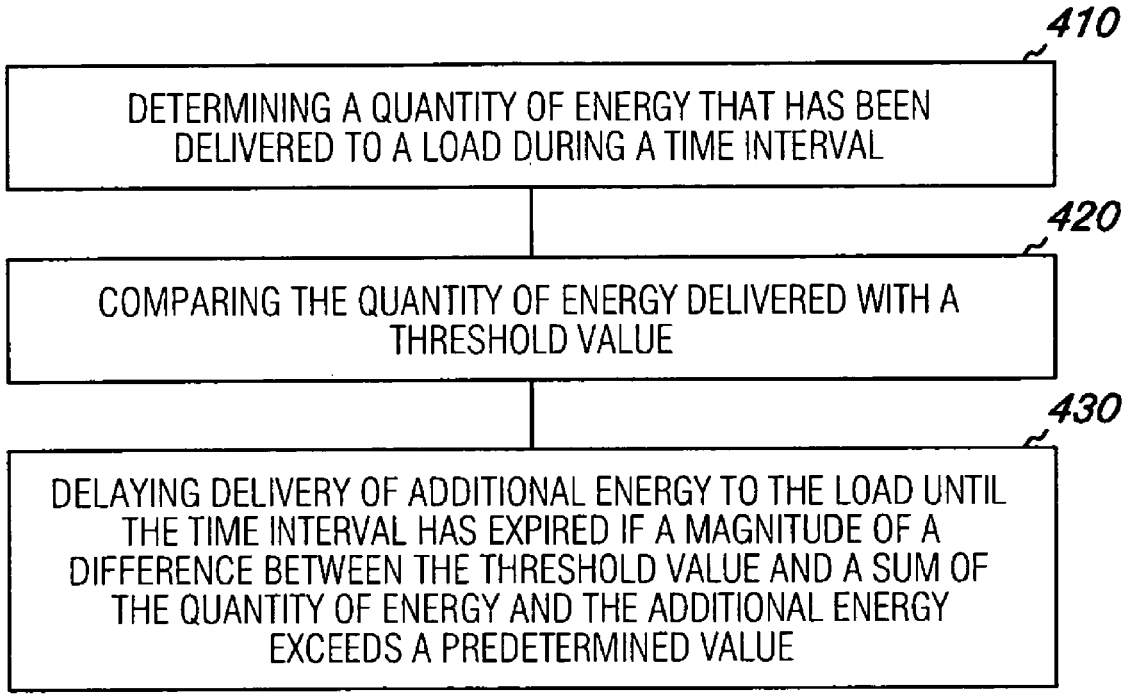
FIG. 4 is a block diagram illustrating a method for utilizing an apparatus according to an embodiment of the present disclosure.

FIG. 4 is a block diagram illustrating a method for utilizing an apparatus according to an embodiment of the present disclosure. Unless explicitly stated, the method embodiments described herein are not constrained to a particular order or sequence.

Additionally, some of the described method embodiments, or elements thereof, can occur or be performed at the same, or at least substantially the same, point in time. The embodiments described herein can be performed using logic, hardware, application modules, or combinations of these elements, and the like, to perform the operations described herein.

In various embodiments, the elements just described can be resident on the systems, apparatuses, and/or devices shown herein, or otherwise. Logic suitable for performing embodiments of the present disclosure can be resident in one or more devices and/or locations. Processing modules (e.g., associated with a regulator control device) can include one or more individual modules that perform a plurality of functions, separate modules connected together, and/or independent modules.

The embodiment illustrated in FIG. 4 includes determining a quantity of energy that has been delivered to a load during a time interval, as shown in block 472. As described above, the electrical energy delivered during the particular time interval under consideration can be determined by accessing values in a LUT having two or more dimensions using measured parameters such as voltage and a width of pulses.

Block 474 of the embodiment shown in FIG. 4 includes comparing the quantity of energy delivered with a threshold value. As described above, the allowable quantity of energy threshold can be determined by an applicable safety standard and/or empirical considerations such as longevity of components associated with a load, which, in some embodiments, can be a printhead of a printing device, and/or quality of a product produced by the apparatus (e.g., printed material on a print medium), among other considerations, that can be affected by the quantity of energy delivered during a time interval.

Block 476 of the embodiment shown in FIG. 4 further includes delaying delivery of additional energy to the load until the time interval has expired if a magnitude of a difference between the threshold value and a sum of the quantity of energy and the additional energy exceeds a predetermined value. One of a number of results that can occur due to delaying delivery of additional energy until a time interval has expired is cooling of an energy supply and/or a load and/or associated components due to reduced dissipation of heat resulting from delivery of energy at a lower rate.

Cooling of the energy supply and/or the load and/or associated components can result in operating in a temperature range more conducive to achieving a desired output from the apparatus having an energy supply, and, consequently, a load, being controlled by an energy regulator. For example, elevated heat levels in an imaging device can decrease longevity of energy supplies, printheads and/or associated components, decrease performance levels of the energy supplies, printheads and/or associated components, deleteriously affect the appearance of images on a page of the print medium printed by printheads and/or associated components having elevated temperatures, and/or decrease safety of personnel in the vicinity of the imaging device, among other effects that can be lessened by allowing cooling by limiting energy delivered.

Although specific embodiments have been illustrated and described herein, those of ordinary skill in the art will appreciate that an arrangement calculated to achieve the same, or similar, results can be substituted for the specific embodiments shown. This disclosure is intended to cover all adaptations or variations of various embodiments of the present disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the present disclosure includes other applications in which the above structures and methods are used. Therefore, the scope of various embodiments of the present disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the disclosed embodiments of the present disclosure have to use more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A machine-readable medium having instructions stored thereon for executing a method comprising:

determining a quantity of energy that has been delivered to a load during a time interval by measuring a voltage and measuring a pulse width across the load and using a look up table;

comparing the quantity of energy delivered with a threshold value;

delaying delivery of additional energy to the load until the time interval has expired if a magnitude of a difference between the threshold value and a sum of the quantity of energy and the additional energy exceeds a predetermined value and preventing application of pulses to an energy regulator during a remainder of the time interval if the sum exceeds the threshold value.

2. The machine-readable medium of claim 1, wherein the threshold value corresponds to a fault condition for which the threshold value exceeds the sum by at least the predetermined value; and further comprising stopping delivery of the additional energy until power cycling of a system including the load.

3. The machine-readable medium of claim 2, wherein the threshold value is determined by limiting the quantity of the energy deliverable during the time interval based on considering at least one criterion selected from a group including a longevity of a printhead, a longevity of a component of an imaging device, and an image quality on a print medium.

4. The machine-readable medium of claim 1, wherein the threshold corresponds to a value to permit compliance with a standard and the standard corresponds to a safety standard that limits apparent power supplied by a power source to a test load at a second time interval after coupling the test load to the power source.

5. The machine-readable medium of claim 1, wherein the threshold value corresponds to a fault condition for which the sum exceeds the threshold value by at least the predetermined value and further comprising stopping delivery of the additional energy at least until power cycling of a system including the load.

6. A machine-readable medium having instructions stored thereon for executing a method comprising:

measuring a voltage and measuring a pulse width across a load to determine energy delivered to the load using a look up table;

determining a quantity of energy deliverable using measured values of the pulse width and the voltage;

adding the quantity of the energy to a value corresponding to the energy delivered;

determining if a sum of the quantity of the energy and the value exceeds a threshold for a time interval; and preventing application of pulses to an energy regulator during a remainder of the time interval if the sum exceeds the threshold.

7. The medium of claim 6, wherein measuring the voltage includes measuring the voltage of a power source a plurality of times within the time interval.

8. The medium of claim 6, wherein the measuring the pulse width includes starting a pulse width timer at a beginning of a pulse.

9. The medium of claim 8, wherein the starting of the pulse width timer includes either starting the pulse width timer synchronously with a load drawing power from a power source providing the voltage or asynchronously with the load drawing power from the power source.

10. The medium of claim 8, further comprising setting a length for the time interval that exceeds a length of time used by one or more printheads for printing of a page of a print medium.

11. The medium of claim 7, wherein a regulator controller generates a pulse responsive to an output voltage of an energy regulator.

12. The medium of claim 6, further comprising allowing application of a pulse to an energy regulator during the time interval if the sum is less than the threshold.

13. The medium of claim 6, further comprising stopping delivery of power until the time interval has expired when the sum is at least a predetermined value less than the threshold within the time interval.

14. An apparatus, comprising:

an accumulator;

a comparator to determine whether a sum of a deliverable quantity of energy and a cumulative quantity of energy delivered to a load during a time interval, as indicated by a value in the accumulator formed by summing estimates of quantities of energy provided to the load during the time interval by measuring a voltage and measuring a pulse width across the load and using a look up table, exceeds a threshold during the time interval;

a circuit to cause an energy regulator to interrupt delivery of power to the load until the time interval has ended when the sum exceeds the threshold during the time interval;

wherein each estimate of the estimates of quantities is determined by measuring a pulse width and a voltage during the time interval; and wherein the load corresponds to a printhead of an imaging device.

15. The apparatus of claim 14, wherein the comparator, the accumulator, and the circuit are elements of a regulator control device implemented in one a group of component types including a programmable logic device, a field programmable gate array, or an application specific integrated circuit.

* * * * *

UNITED STATES PATENT AND TRADEMARK OFFICE

CERTIFICATE OF CORRECTION

PATENT NO. : 7,832,820 B2
APPLICATION NO. : 11/590048
DATED : November 16, 2010
INVENTOR(S) : Sam M. Sarmast It is certified that error appears in the above-identified patent and that said Letters Patent is hereby corrected as shown below:

In column 14, line 25, in Claim 11, delete "claim 7," and insert -- claim 6, --, therefor.

Signed and Sealed this
Third Day of July, 2012

David J. Kappos

David J. Kappos
*Director of the United States Patent and Trademark Office*